US012690693B2

(12) United States Patent
Longenecker et al.

(10) Patent No.: US 12,690,693 B2
(45) Date of Patent: Jul. 28, 2026

(54) CONVERTIBLE TODDLER CHAIR AND STANDING PLATFORM

(71) Applicant: ARTSANA USA, INC., Lancaster, PA (US)

(72) Inventors: Michael L. Longenecker, Lancaster, PA (US); Stephen J. Wood, Kutztown, PA (US); Raymond Evan Good, Lancaster, PA (US)

(73) Assignee: Artsana USA, Inc., Lancaster, PA (US)

( * ) Notice: Subject to any disclaimer, the term of this patent is extended or adjusted under 35 U.S.C. 154(b) by 109 days.

(21) Appl. No.: 18/750,564

(22) Filed: Jun. 21, 2024

(65) Prior Publication Data

US 2025/0049228 A1 Feb. 13, 2025

Related U.S. Application Data

(60) Provisional application No. 63/532,188, filed on Aug. 11, 2023.

(51) Int. Cl.

| | |
|---|---|
| ***A47D 1/02*** | (2006.01) |
| ***A47C 12/02*** | (2006.01) |
| ***A47D 1/00*** | (2006.01) |
| ***A47D 11/00*** | (2006.01) |

(52) U.S. Cl.

CPC ..... *A47D 1/023* (2017.05); *A47D 1/004* (2013.01); *A47D 1/008* (2013.01); *A47D 11/00* (2013.01); *A47C 12/02* (2013.01)

(58) Field of Classification Search

CPC ..... A47D 1/0083; A47D 1/023; A47D 1/00; A47D 11/00; A47C 12/02; A47C 13/00

USPC ..... 297/118

See application file for complete search history.

(56) References Cited

U.S. PATENT DOCUMENTS

| | | | | | |
|---|---|---|---|---|---|
| 1,479,594 | A | | 1/1924 | Fennell | |
| 1,663,960 | A | | 3/1928 | Sweigard | |
| 1,671,013 | A | | 5/1928 | Conners | |
| 1,738,339 | A | * | 12/1929 | Whiting | A47D 1/0083 297/423.26 |
| 1,831,143 | A | | 11/1931 | Shambaugh | |
| 2,619,152 | A | | 11/1952 | Lane | |
| 2,814,334 | A | | 11/1957 | Lane | |
| 2,888,062 | A | | 5/1959 | Lockwood | |
| 2,998,862 | A | | 9/1961 | Earley | |
| 3,025,101 | A | | 3/1962 | McKinnie | |
| 3,059,722 | A | | 10/1962 | Rouse | |

(Continued)

*Primary Examiner* — Alfred J Wujciak

(74) *Attorney, Agent, or Firm* — Saxton & Stump, LLC

(57) ABSTRACT

A toddler chair convertible to a standing platform including a foldable support frame with front and rear legs configured to stably support a standing platform and an elevated seat assembly for a toddler. The seat assembly includes a seating portion, a backrest portion, and a moveable elevating frame. The seating assembly is vertically moveable in relation to the support frame. The seating and backrest portions are moveable in relation to each other. A linkage interconnecting the seating portion and the support frame controls movement of the seating portion as the seat assembly is moved in relation to the support frame. In one configuration the seating assembly disposed generally above the platform and is operable as a seat for a child. In a second configuration, the seating portion is repositioned into general alignment with the backrest portion to allow a child to stand on the platform below.

20 Claims, 12 Drawing Sheets

(56) References Cited

U.S. PATENT DOCUMENTS

| | | | | |
|---|---|---|---|---|
| 3,224,530 | A | 12/1965 | King et al. | |
| 3,960,241 | A | 6/1976 | Arias | |
| 4,276,955 | A | 7/1981 | Hickman | |
| 5,507,549 | A | 4/1996 | Cope | |
| 7,828,117 | B2 | 11/2010 | Cole | |
| 9,986,850 | B2 * | 6/2018 | Haut | A47D 11/002 |
| 11,039,693 | B2 | 6/2021 | Gullick | |
| 11,172,764 | B2 | 11/2021 | Tackaberry et al. | |
| 11,510,500 | B1 | 11/2022 | Harris | |
| 11,564,501 | B2 | 1/2023 | Dziak et al. | |
| 11,622,632 | B2 | 4/2023 | Tackaberry et al. | |
| 11,723,477 | B2 | 8/2023 | Rogers et al. | |
| 2010/0237666 | A1 * | 9/2010 | Buckavich | A47D 1/023 297/464 |
| 2022/0290498 | A1 | 9/2022 | Hradisky | |
| 2023/0146888 | A1 * | 5/2023 | Dziak | A47D 1/006 182/33 |

* cited by examiner

CONVERTIBLE TODDLER CHAIR AND STANDING PLATFORM

CROSS REFERENCE TO RELATED APPLICATIONS

This application claims priority benefit to provisional patent application 63/532,188 filed on Aug. 11, 2023, the entirety of which is incorporated by reference herein.

FIELD OF THE INVENTION

The present disclosure is generally directed to portable seating for small children, and more particularly to a portable seat that may be quickly and conveniently converted for use as a highchair or a standing platform.

BACKGROUND OF THE INVENTION

Portability and convenience of use of childcare accessories are increasingly important considerations among consumers. This is particularly important for chairs, stools, and other products designed primarily for use in the home where space is usually limited. To this end, many such products are designed to be easily adaptable to fulfill multiple needs with a single product and collapsed into a compact configuration when not in use.

Many learning activities for children occur in the home kitchen or other locations having elevated counters or work surfaces. Elevated work surfaces in most residential settings are typically located approximately 36 inches above the floor. In order for young children to view and access these elevated surfaces, an elevated step or platform is required. Young children may have difficulty maintaining stability and balance on a step stool. Optimal access to countertop surfaces for a young child requires a step height of 15 to 18 inches above the floor. These demands have given rise to a new device, the learning tower, which provides an optimally located standing platform and an elevated structure above the platform to provide stabilizing handholds or guards for the child.

Stability of a standing platform requires a substantial spatial footprint which presents problems for storage of the apparatus when not in use. The problem is compounded when the standing platform structure is single purpose and does not include adaptability to allow it to fulfill other needs for the child.

What is needed is a multi-purpose structure that can fulfill the standing platform need and a secondary need, such as an elevated toddler chair or highchair. Additional benefits will be realized by a combination standing platform and toddler chair that is foldable into a compact configuration for storage when not in use. Other features and advantages will be made apparent from the present specification. The teachings disclosed extend to those embodiments that fall within the scope of the claims, regardless of whether they accomplish one or more of the aforementioned needs.

SUMMARY OF THE INVENTION

In one aspect, a toddler chair that is easily convertible to a standing platform without the need for tools is provided. The toddler chair includes a support frame having a front leg and a rear leg configured to stably support a standing platform and an elevated seat assembly for the toddler. The seat assembly includes a seating portion and a backrest portion connected to an elevating frame. The seat assembly may include an armrest. The seating assembly is vertically moveable in relation to the support frame. The seating and backrest portions are moveable in relation to each other. A linkage interconnecting the seating portion and the support frame controls movement of the seating portion as the seat assembly is moved in relation to the support frame. In one configuration the seating assembly disposed generally above the platform and is operable as a seat for a child. In a second configuration, the seating portion is repositioned into general alignment with the backrest portion to allow a child to stand on the platform below.

In another aspect, a convertible toddler standing platform and chair is provided including a front leg and a rear leg that are hingedly connected to allow the legs to be positioned in a compact arrangement when not in use. A moveable platform is pivotally coupled to the front leg. A pivoting linkage interconnects the platform and the rear leg. The platform and pivoting linkage allow the front and rear legs to be selectively positioned in an operable configuration for use and a folded configuration for storage. When configured for use, the platform is generally horizontally disposed between the front and rear leg with the distal legs ends spaced apart for stability. A travel stop is provided to engage the linkage and retain it and the platform in a stationary operable position. The pivot arrangement of the linkage is positioned slightly over-center when the travel stop is engaged to inhibit unintended reverse pivoting movement of the linkage while the standing platform/chair is in use. The over-center arrangement also minimizes stresses in any latching mechanism that may be provided to prevent accidental or unintentional movement from the operable configuration. Platform movement toward the folded configuration pivots the rear leg toward the front leg for a more compact stowable arrangement.

In another aspect of the invention, a toddler chair includes a support frame having a front leg and a rear leg configured to stably support a standing platform and an elevated seat assembly for a toddler. The front and rear legs are hingedly connected to allow the support frame to be arranged in a deployed configuration for use or a folded configuration for storage when not in use. The standing platform is pivotally coupled to the front leg and to the rear leg through an interconnecting pivoting linkage which coordinates movement of the support frame. When folded, the standing platform is repositioned to stabilize the folded frame and allow it to stand unsupported in a generally upright and stable manner.

In another aspect, a convertible standing platform and toddler chair includes a support frame having a front leg and a rear leg configured to stably support a standing platform and an elevated seat assembly for the toddler. The seat assembly includes a seating portion and a backrest portion connected by an elevating frame. The seating assembly is vertically moveable in relation to the support frame and configurable for use as a toddler seat or for a learning tower. The seating and backrest portions are moveable in relation to each other. Moving the seating assembly toward the learning tower configuration moves the seating portion into alignment with the backrest portion and generally shifts the seat assembly rearwardly to allow the learning tower to be positioned closely adjacent to a cabinet supporting a countertop thereby allowing a child standing on the platform to access the countertop.

Other features and advantages of the present invention will be apparent from the following more detailed description of the preferred embodiment, taken in conjunction with the accompanying drawings which illustrate, by way of example, the principles of the invention.

BRIEF DESCRIPTION OF DRAWINGS

The advantages of this invention will be apparent upon consideration of the following detailed disclosure of the invention, especially when taken in conjunction with the accompanying drawings wherein.

Wherever possible, the same reference numbers will be used throughout the drawings to represent the same parts.

DETAILED DESCRIPTION OF THE INVENTION

Figure 4:
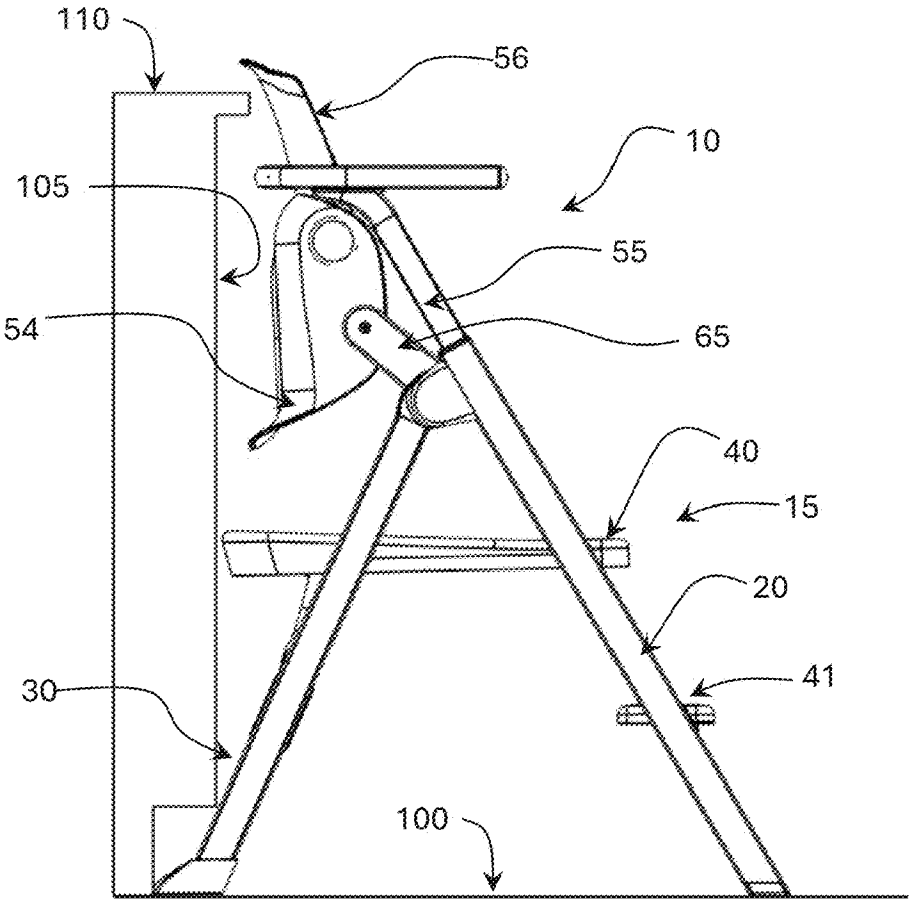
FIG. 4 is a side elevation view of the embodiment of FIG. 1 configured as standing platform and shown positioned adjacent to a counter-height work surface.
Figure 3:
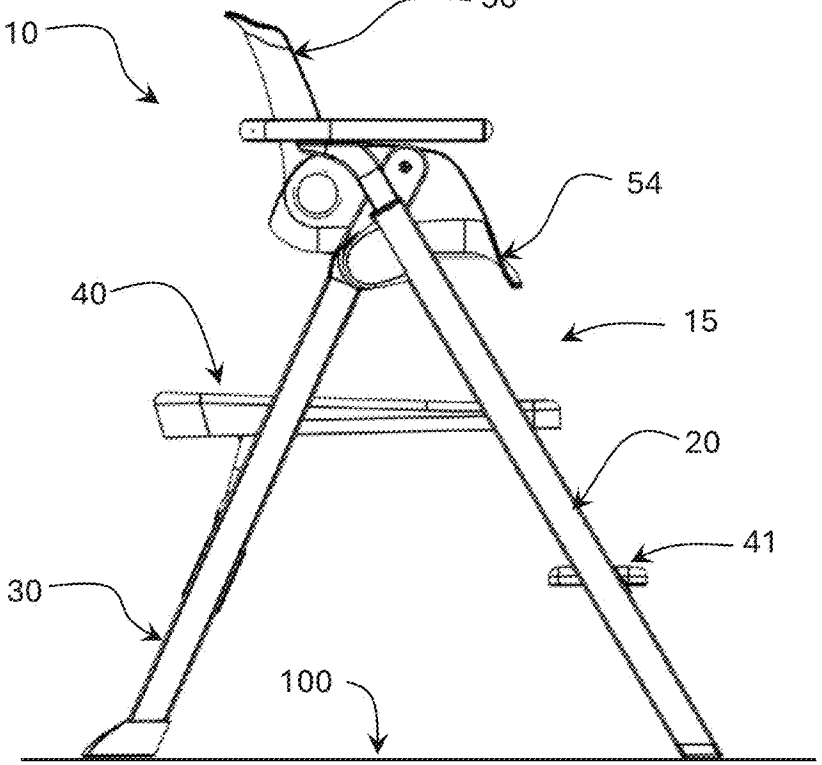
FIG. 3 is a side elevation view of the embodiment of FIG. 1 shown configured as a toddler seat.
Figure 5:
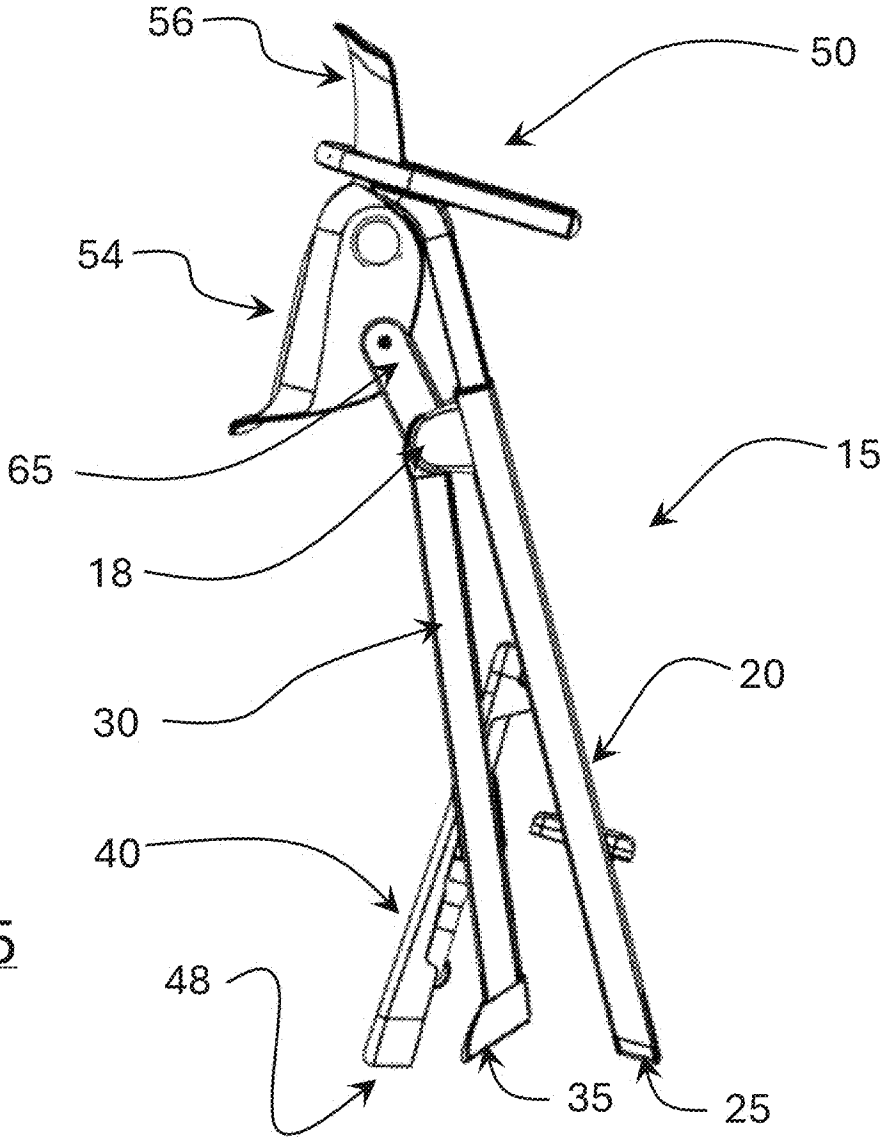
FIG. 5 is perspective view of the embodiment of FIG. 1 shown in a folded arrangement for storage.
Figure 6:
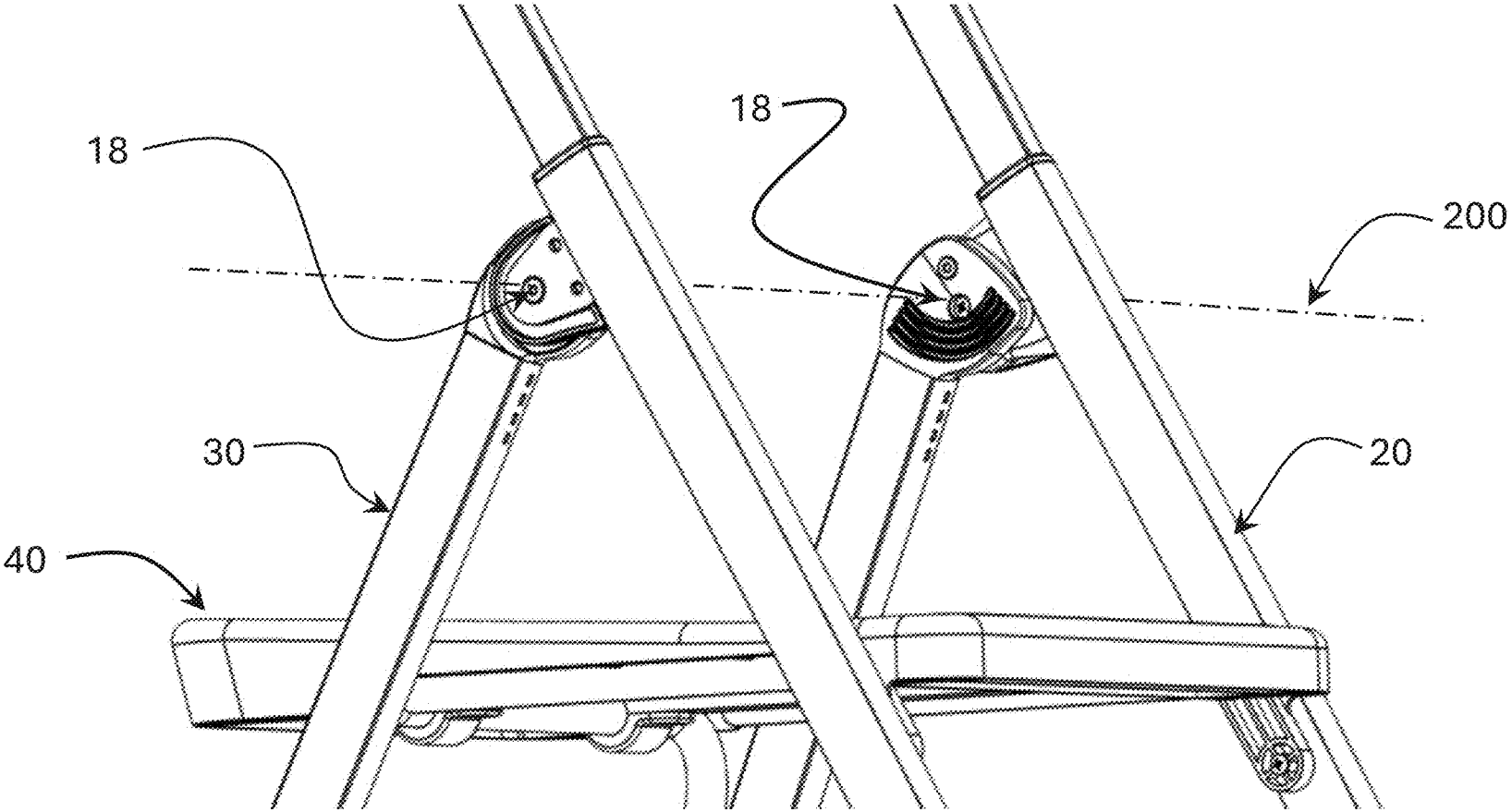
FIG. 6 is a partial view of a hinge connection between the front and rear legs of the invention.
Figure 8:
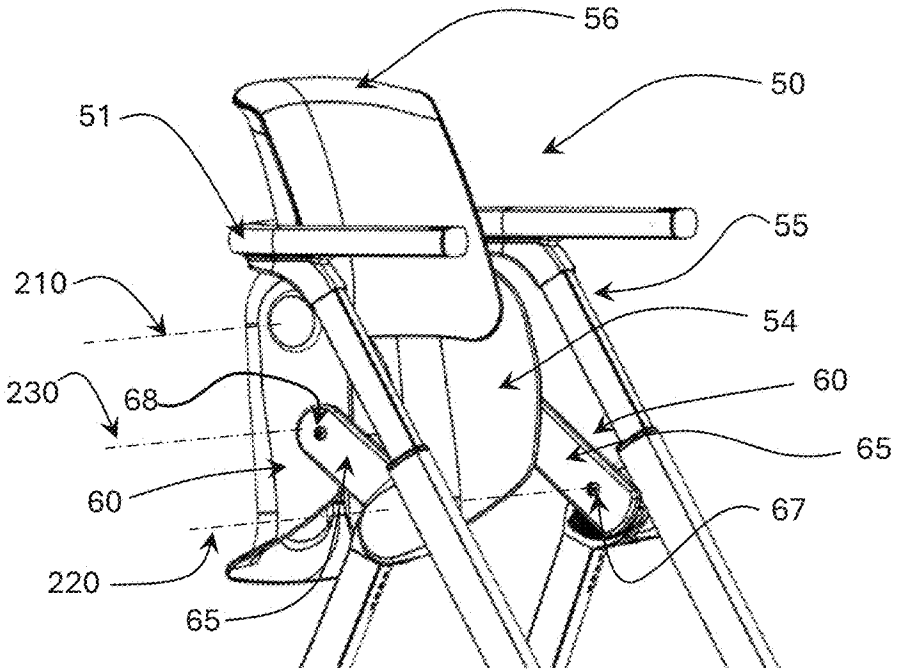
FIG. 8 is a partial view of the mechanism shown in FIG. 7, shown in a second configuration.
Figure 7:
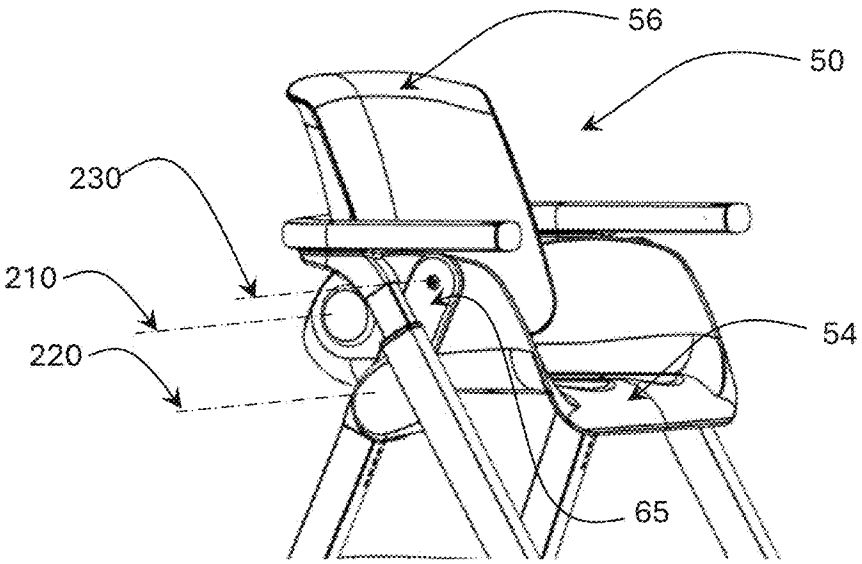
FIG. 7 is a partial view of an embodiment of a mechanism for repositioning the seat, shown in a first configuration.
Figure 10:
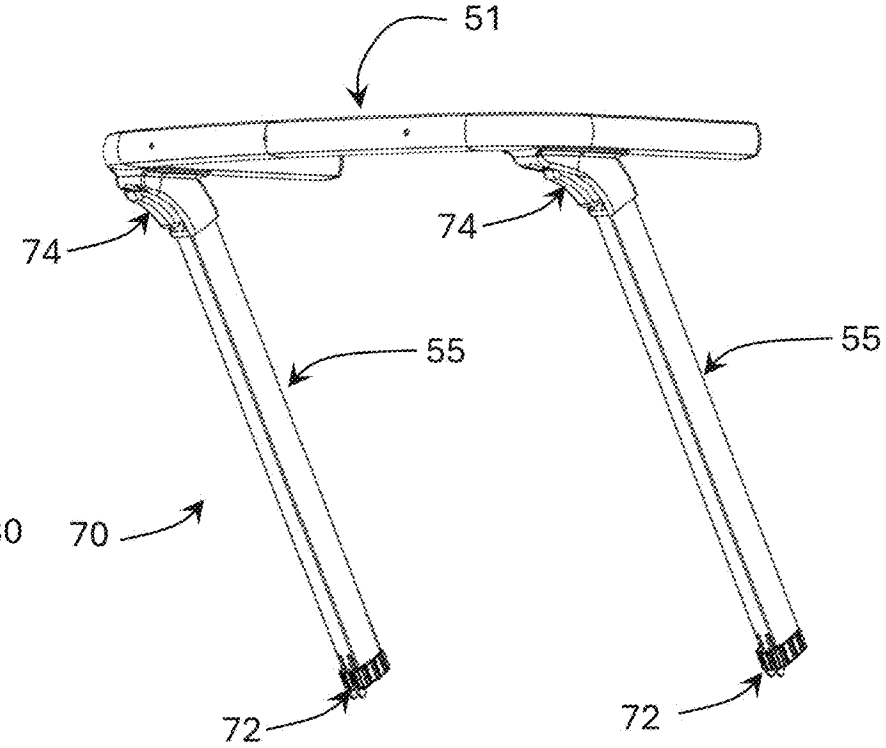
FIG. 10 is a partial view of the elevating frame in the seat assembly illustrating an embodiment of the elevating frame retention mechanism.
Figure 9:
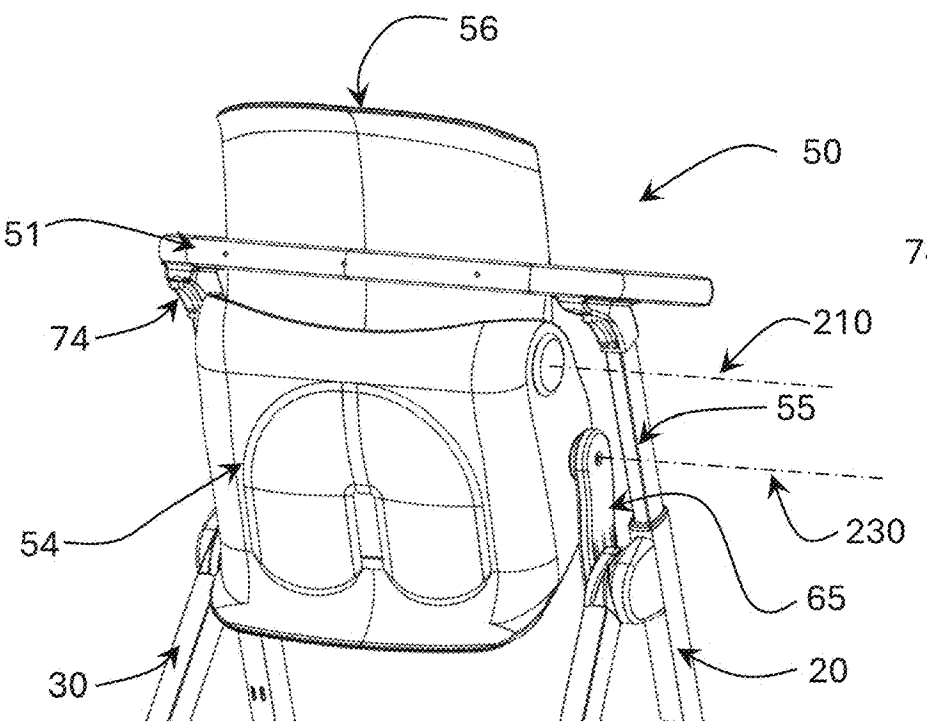
FIG. 9 is an alternate view of the repositioning mechanism shown in FIG. 8.

Referring to the figures, a convertible toddler chair and standing platform apparatus 10 is shown with a collapsible frame 15 comprising a front leg 20, a rear leg 30, and a platform panel 40. The front and rear leg are pivotally coupled at their proximal ends by hinge 18 and pivotable about a hinge axis 200 between an unfolded configuration (FIGS. 1-4) and a folded configuration (FIG. 5). When unfolded, feet 25, 35 provided on the distal ends of the front and rear legs support the apparatus 10 on a floor 100 or similar level surface.

A seat assembly 50 is provided and selectively configurable as a seat to support a toddler occupant or to reposition a portion of the seat to provide clearance for a toddler to stand comfortably on the platform panel 40. The seat assembly 50 includes a seating panel 54 and a backrest panel 56. An elevating frame 51 is moveably connected to frame 15 adjacent to the hinge 18. The elevating frame 51 is selectively positionable in generally opposing lowered (FIG. 1) and raised (FIG. 2) positions. The elevating frame 51 may include a downward extending telescoping extension 55 which engages the front leg 20 to facilitate raising and lowering of the elevating frame 51. The elevating frame 51 may also include an armrest 52. Elevating frame 51 may be generally U-shaped in a horizontal plane to extend behind the backrest pane 56 and forwardly on either side as armrests 52.

A retention mechanism may be provided to hold the elevating frame 51 in at least the raised position until selectively repositioned by a user. The retention mechanism 70 may include moveable pawls 72 positioned inside of the telescoping extension 55 and engageable with the interior portion of the front leg. The pawls 72 may include resilient biasing members to urge the pawls into a locking engagement with the interior portion of the leg. The leg interior may be configured with features to aid in the pawl engagement, such as a rack or spaced-apart recesses or protrusions. A release actuator 74 may be provided and operably connected to selectively disengage the pawls 72 from engagement with the telescoping extension and allow the elevating frame 51 to be moved with respect to the frame 15. The operable connection may include a rod, cable or the like. The release actuator may be located on the elevating frame 51 to allow ease of operation by a user when grasping the armrests 52 or elevating frame 51 to adjust the configuration of the seat assembly 50.

Figure 2:
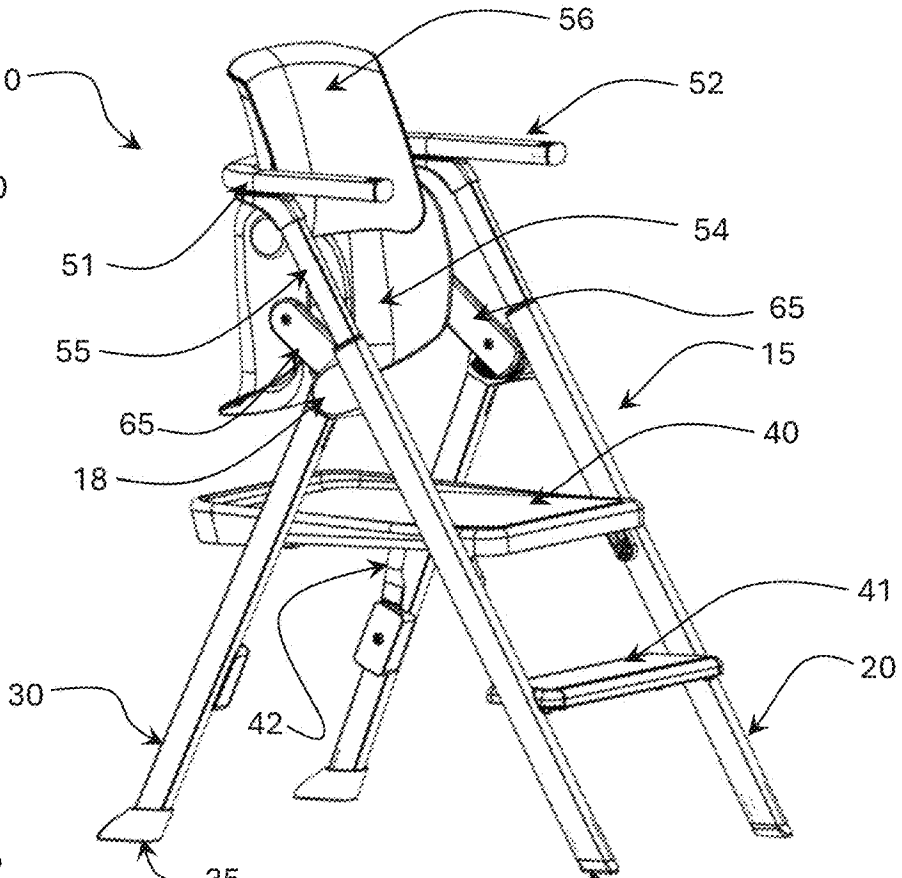
FIG. 2 is a perspective view of the embodiment shown in FIG. 1 shown configured for use as a standing platform.
Figure 1:
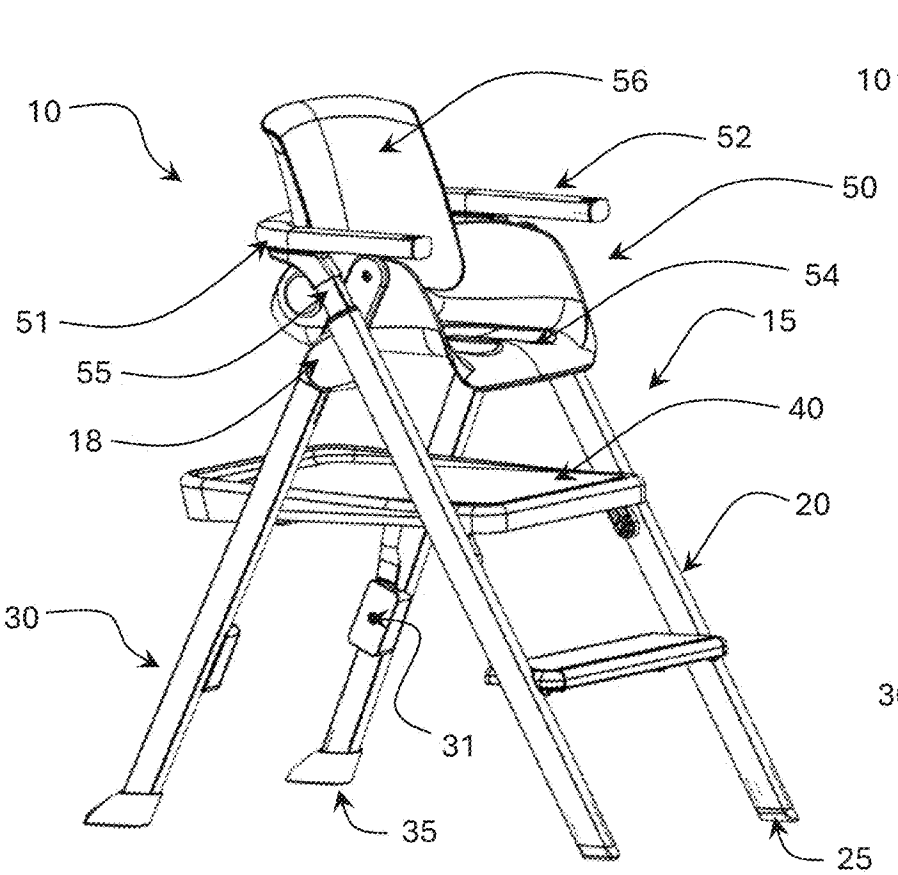
FIG. 1 is a perspective view of a first embodiment of the present invention shown configured as a toddler chair and unfolded for use.

Seating panel 54 and backrest panel 56 may be hingedly or pivotally connected allowing movement of the seating panel 54 between a generally horizontal alignment generally parallel to platform 40 below and angled in relation to the backrest panel allowing its use as a seat to support a child (seating configuration, FIG. 1) and a generally upright orientation in which the seating panel surface is rotated downwardly and rearwardly to a position generally aligned with the backrest panel surface which allows a clear space above the platform panel 40 to allow a toddler to stand on the platform panel 40 below for use of the apparatus 10 as a standing platform or learning tower (standing configuration, FIG. 2). In this configuration, the seating panel and backrest panel surfaces form an upright barrier adjacent to the rear of the platform for a child user to lean against while standing on the platform and limits child movement toward the rearward end of the platform. The backrest panel 56 may be connected to the elevating frame 51 for movement therewith. The seating panel 54 may be hingedly or pivotally connected to the backrest panel 56 and may move about seatback hinge axis 210. The seating and backrest panels 54, 56 may be configured to limit the extent of downward rotational movement of the seating panel 54. Movement of the seating panel 54 is effected by raising and lowering the elevating frame 51 and attached backrest panel 56.

Figures 11A, 11B, 11C, 11D, 11E:
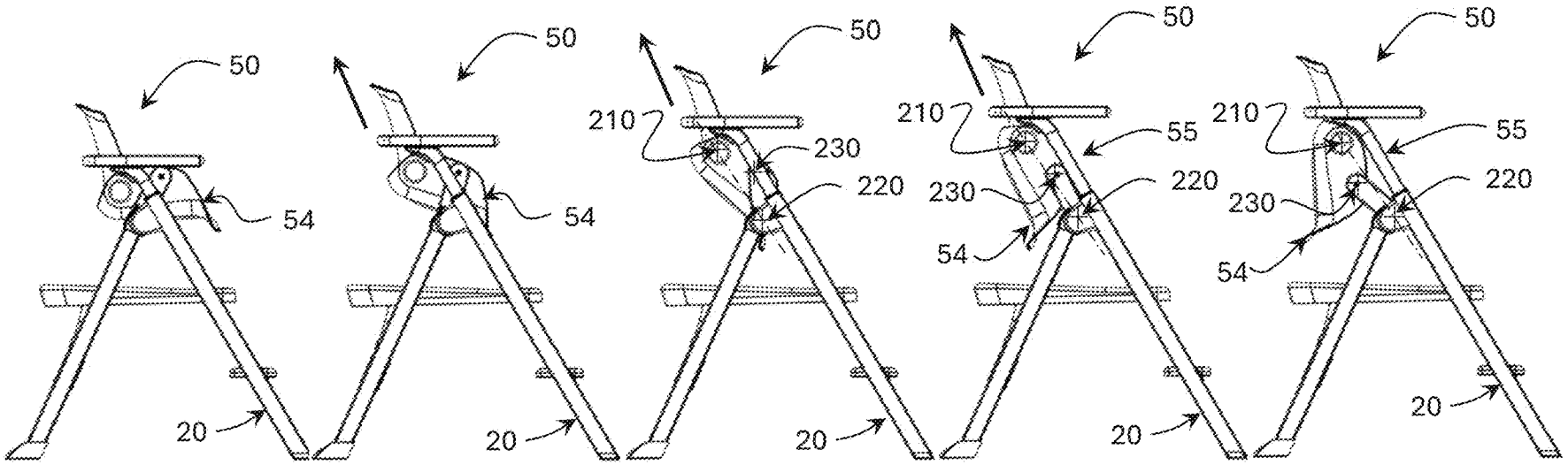
FIGS. 11A-11E illustrate the movement of the seat assembly between a highchair configuration and a standing platform configuration.
Figure 12:
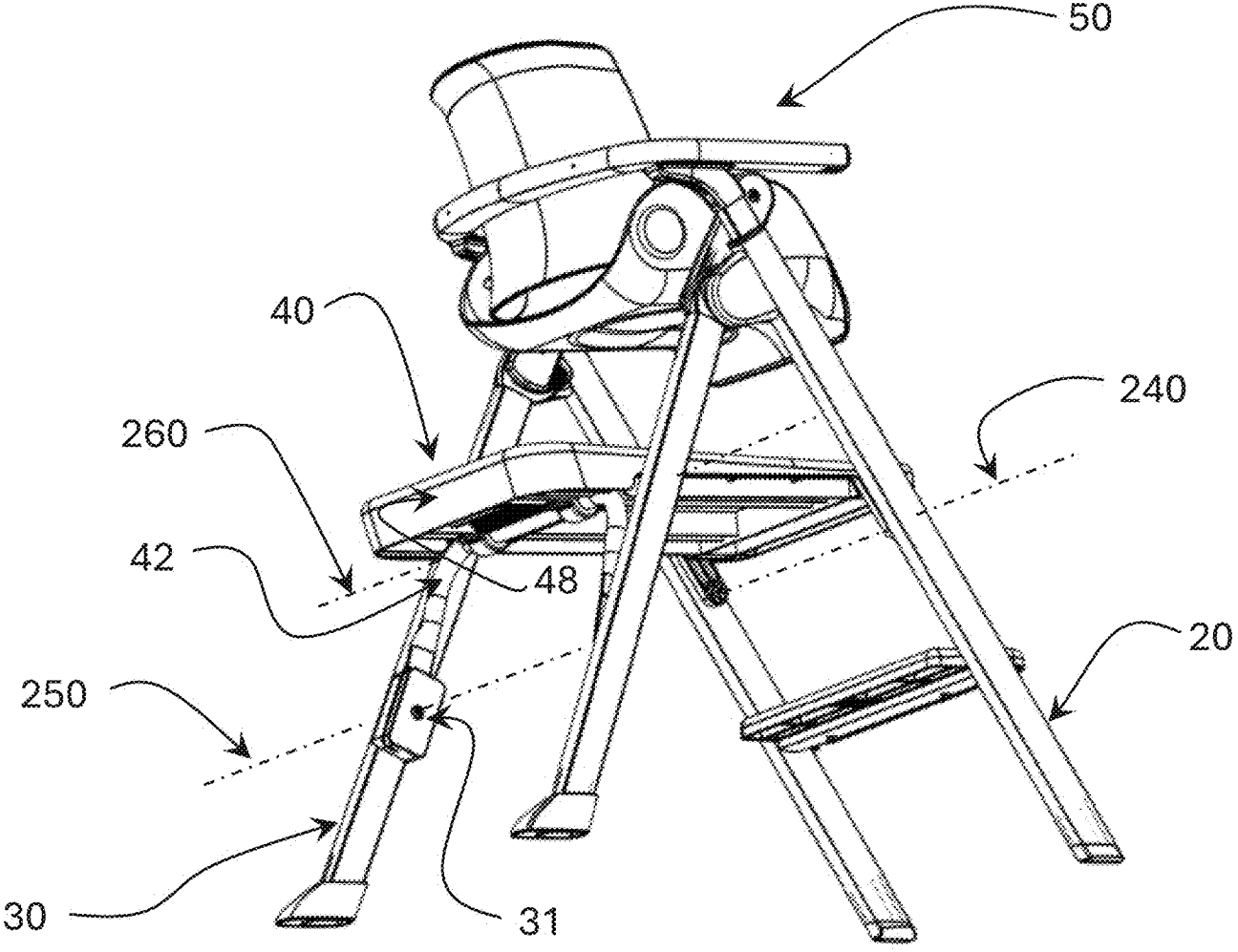
FIG. 12 is a rear perspective elevation view of the toddler seat of FIG. 1 in the unfolded position showing the platform folding linkage.
Figure 13:
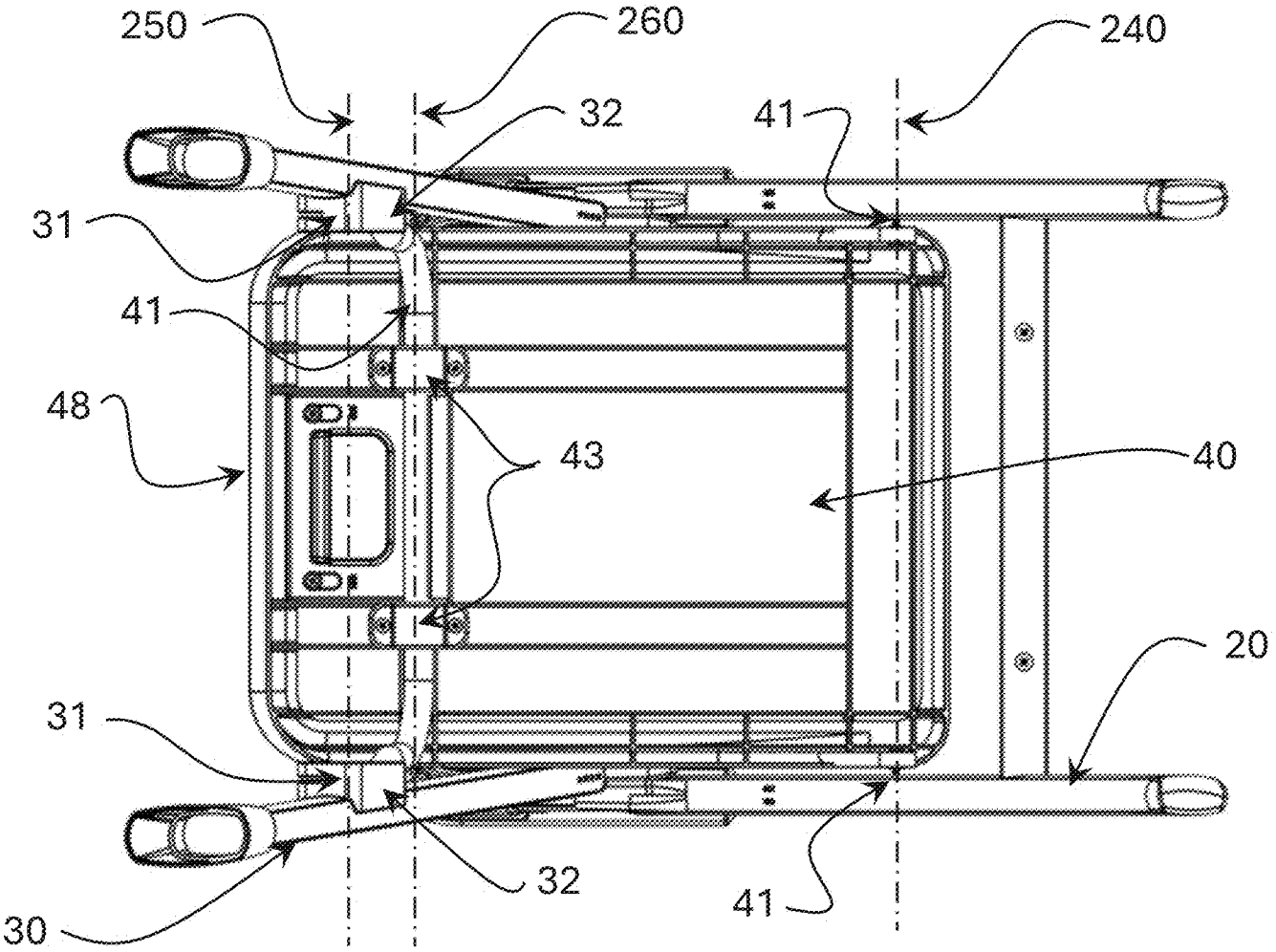
FIG. 13 is bottom view of the toddler seat.

A seat link 60 interconnecting the foldable frame 15 and the seating panel 54 may be provided and configured to cause seating panel 54 movement as the elevating frame 51 is moved between elevated and lowered positions. One embodiment of seat link 60 may include an elongate link member 65 pivotally connected at a first pivot point 67 to the frame 15 and at a second pivot point 68 the seating panel 54. The seat link 60 may include separate link members 65 disposed on opposite sides of the seating panel 54 so that the respective first and second pivot points 67, 68 define first and second pivot axes 220, 230. The link members 65 and location of the first and second pivot points 67, 68 may be configured to coordinate rotation of the seating portion 54 about hinge axis 210 as the back panel 56 is raised and lower by movement of the elevating frame 51. The spatial relationship of the first and second end 67, 68 pivot points may be configured to position the link member 65 in an over-center configuration to maintain the elevating frame 51 in the elevated position either in lieu of or in combination with retention mechanism 70. As best illustrated in FIGS. 11C through 11E, the over-center seat link configuration requires elevating the elevating frame 51 slightly from the elevated position to allow the link to rotate slightly so that when downward movement of the elevating frame 51 commences, the seat link may rotate fully to move the seating panel toward the seating position.

The seat assembly 50 may include provisions to secure a child occupant in the seat when the apparatus 10 is configured as a toddler seat. These provisions may include a lap belt or provision to secure a booster or other seating apparatus to the seating panel.

In the standing platform configuration, the seat assembly including the elevating frame 51, the seating panel 54 and the backrest panel 56 create a guide barrier generally along three peripheral sides of the platform panel 40 and at a location above the platform panel surface to provide a handhold for stability of a child user of the standing platform. The telescoping motion of the elevating frame 51, preferably aligned with the angled orientation of the front leg 20, causes the backrest portion 56 which may be fixed to the elevating frame 51 to move upwardly and slightly rearwardly. As best illustrated in FIG. 4, this rearward motion shifts the guide barrier formed by the backrest and seating panels rearward in relation to the frame thereby allowing the entire standing platform apparatus to be more closely located adjacent to a cabinet face 105 and offer better access for the child user to the countertop work surface 110.

Platform panel 40 is pivotally connected directly to the front leg 20 at a front pivot 41 for rotation about a first platform axis 240 and indirectly through a pivotally coupled platform support link 42, the interlink causing rotation of the platform panel 40 as the legs are moved between the folded and unfolded configurations. The support link 42 is connected to the rear leg at a leg pivot 31 (pivot axis 250) and to the platform panel 40 at a platform pivot 43 (pivot axis 260). A stop 32 may be provided on the rear leg to engage the support link 42 and limit the degree of support link rotation as the legs rear 30 are moved toward the unfolded configuration. This limitation establishes the extent of the leg unfolding movement and maximum space between the distal ends of the front and rear legs.

Movement of the legs and the platform as the collapsible frame is moved from unfolded to folded positions is illustrated in FIGS. 14A-14E. The collapsible frame 15 may be moved between folded and unfolded positions while the seat assembly is in either the toddler seat or standing platform configuration.

Figures 14A, 14B, 14C, 14D, 14E:
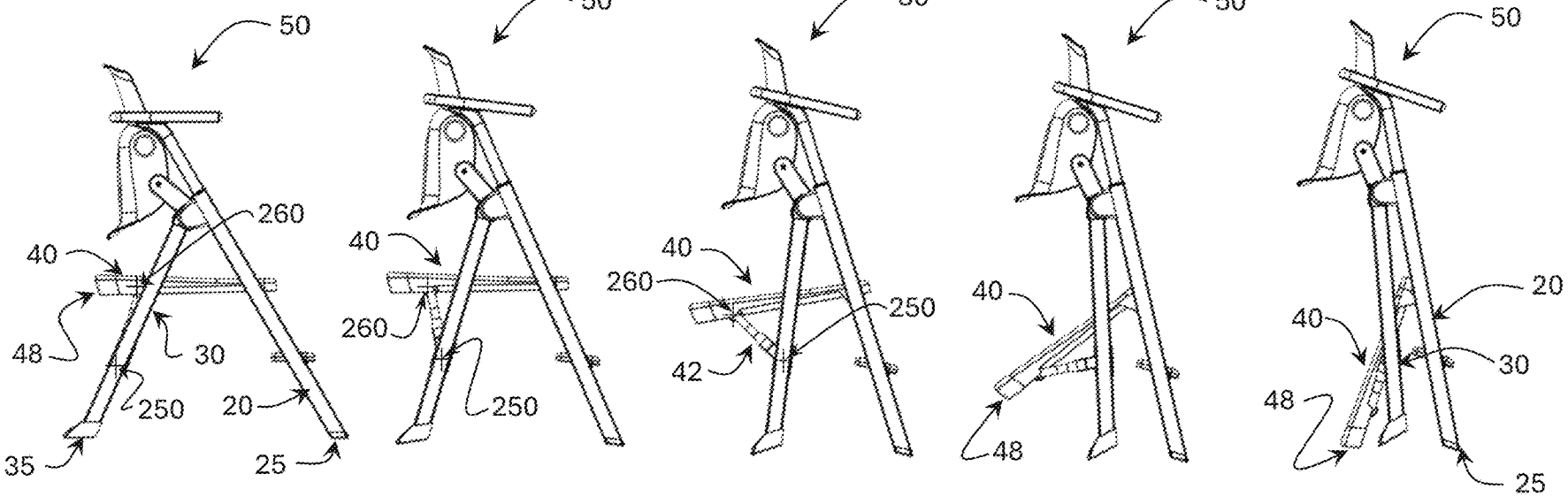
FIGS. 14A-14E illustrate the movement of toddler chair standing platform frame between unfolded and folded configurations.

Platform panel 40 weight and angle of the support link 42 in relation to its pivot connection 31 to rear leg 30 when unfolded is slightly over-center so that weight of the platform holds the chair legs 20, 30 in the unfolded configuration and the support link 42 in adjacent contact with the stop 32. The over-center locking alignment biases the unfolded support legs toward the unfolded configuration thereby minimizing stresses on any latching mechanism that may be provided to retain the support legs in the unfolded configuration. Folding the frame requires first lifting the platform panel 40 slightly to begin moving the support link (rotating the link counter-clockwise as illustrated in FIG. 14A) to then allow the rearward end 48 of the platform panel 42 to begin moving downwardly and allow the frame to be completely folded.

In the folded position of collapsible frame 15 the distal ends of the front and rear legs 20, 30 are brought closely adjacent to reduce the space required for storage. Pivoting movement of the platform 40 moves its rearward end 48 downwardly proximate to the distal ends of the front and rear legs 20, 30. The platform panel may be further configured so that when in the folded orientation, the rearward end 48 may contact the floor surface and, in concert with the front leg foot 25, allow the folded apparatus to stand generally upright on a floor surface.

The pivoting axes including hinge axis 200, first and second axes 220, 230 for the seat linkage and platform pivot axes 240, 250, 260 are all transversely arranged to the folding frame and parallel to one another. The second pivot axis 230 may or may not align with the hinge axis 200 of the folding frame. In the exemplar embodiment, second axis 230 and hinge axis 200 are non-coaxial.

Figure 16:
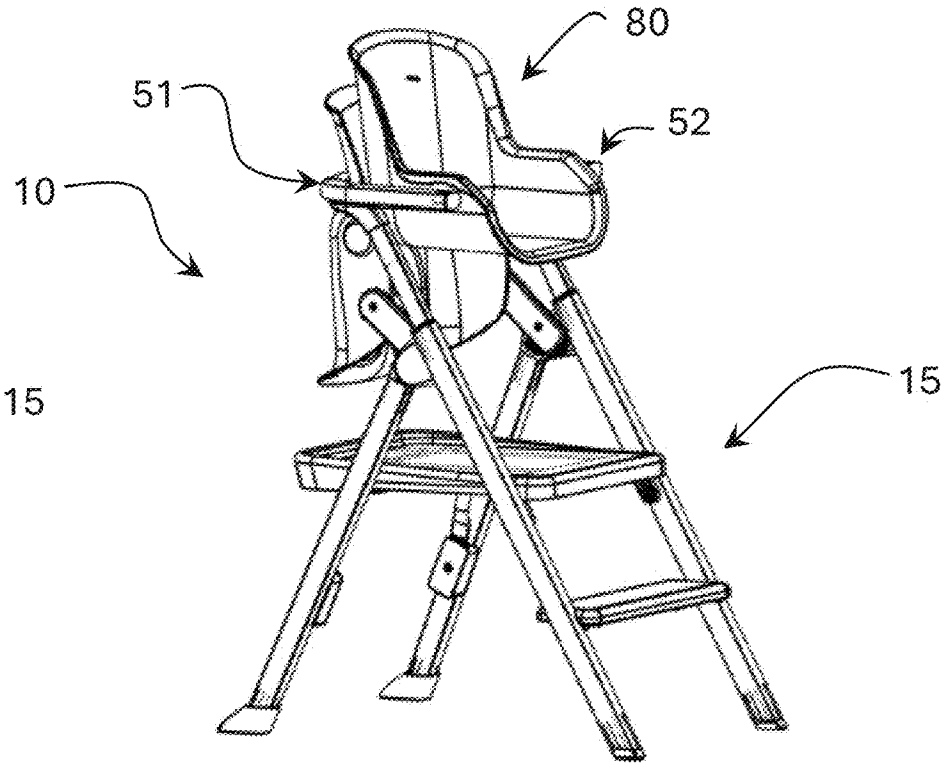
FIG. 16 is a view of the toddler chair and standing platform of FIG. 15 shown in an elevated configuration and having the optional infant seat connected thereto.
Figure 15:
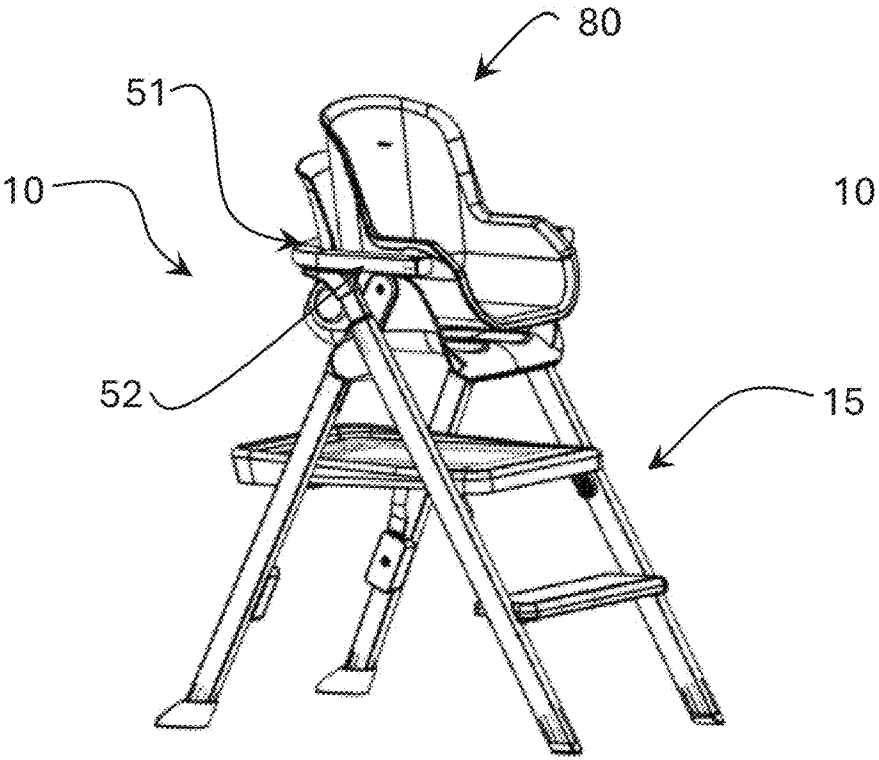
FIG. 15 is a view of an embodiment of a toddler chair and standing platform shown in a lowered configuration and having infant seat connected thereto.

Referring to FIGS. 15 and 16, an optional infant seat 80 is shown attached to the toddler chair and standing platform apparatus 10. The infant seat 80 increases the utility of the toddler chair by providing seating configured for a younger, smaller occupant. The infant seat may be selectively attached to the armrest 52 so that it is moveable between elevated and lowered positions with movement of elevating frame 51.

Figure 18:
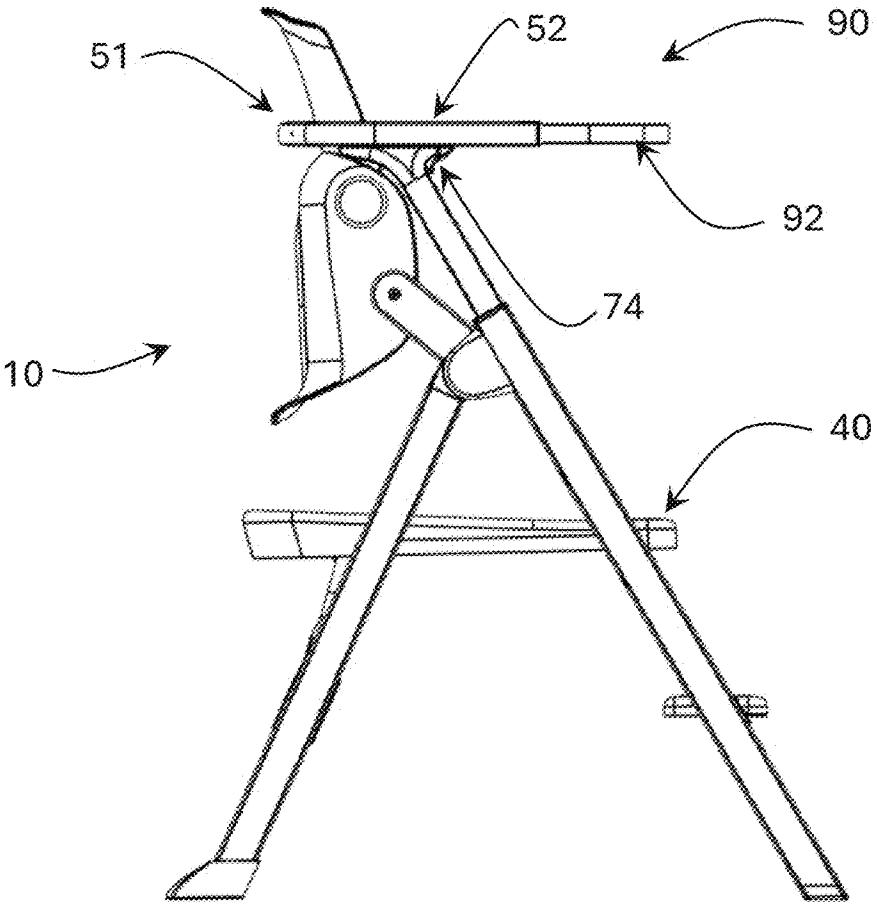
FIG. 18 is an alternate view of the toddler chair and standing platform with safety rail of FIG. 17.
Figure 17:
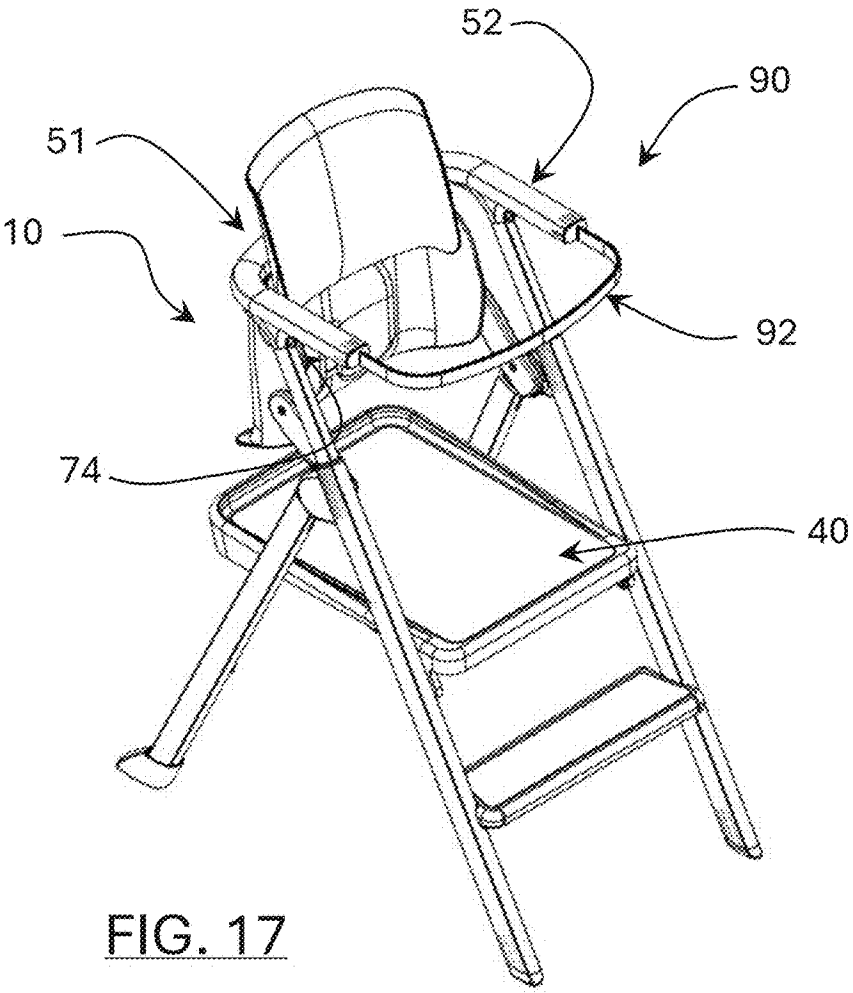
FIG. 17 is a perspective view of an embodiment of a toddler chair and standing platform configured as a standing platform and including a safety rail.

Referring to FIGS. 17 and 18, an embodiment of the toddler chair and standing platform apparatus 10 is shown configured as a standing platform. An optional safety rail 90 is shown and may extend from the armrest 52 of elevating frame 51, connecting the respective armrests on either side of the apparatus 10 to create a barrier to movement by a toddler standing on the platform. In one embodiment, safety rail 90 comprises a ribbon 92 that is flexible in one plane (horizontal) allowing it to bend and create a semi-circular loop at the forward end of the apparatus while being generally rigid in a perpendicular plane (vertical) so that is remains generally co-planar with the armrests 52 from which is extends. The safety rail may include a retracting mechanism disposed in one armrest allowing the ribbon to be selectively extended therefrom and curved to the opposite armrest where it may be selectively secured by any suitable means such as a catch or receptacle. The safety rail 90 may include a rigid member that is selectively attachable to the armrests 52 for use and removeable when not in use.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. A convertible toddler chair and standing platform comprising:

a frame assembly having a front leg and a rear leg, the front and rear legs being pivotally connected and configured to enable movement of the legs between folded and unfolded arrangements;

a platform panel supported by the frame assembly and moveable between a first orientation and a second orientation as the frame assembly is moved;

a seat assembly disposed above the platform and moveably connected to the frame assembly by an elevating frame, the seat assembly including a seating panel and a pivotally coupled backrest panel, movement of the elevating frame causing pivoting movement of the seating panel between a seating configuration and a standing configuration, the seating panel being generally parallel to the platform panel when in the seating configuration;

a platform support link pivotally connected at a first end to the rear leg and at a second end to the platform panel, the platform panel and the platform support link operably connecting the front and rear legs to coordinate movement of the legs and the platform panel between the folded and unfolded arrangements;

wherein first and second end pivoting connections of the platform support link are positioned in an overcenter locking relationship when the platform panel is in the first orientation; and wherein, when the frame assembly is in the folded arrangement, a rearward end of the platform panel cooperates with the front leg to support the toddler chair and standing platform in an upright, self-supporting configuration on a surface.

2. The convertible toddler chair and standing platform of claim 1, wherein the platform support link connection to the rear leg includes a stop to limit movement of the support link as the frame is moved toward the unfolded arrangement.

3. The convertible toddler chair and standing platform of claim 2, wherein the platform panel includes a rearward end, movement of the frame assembly toward the folded arrangement rotating the rearward end downwardly, wherein the toddler chair and standing platform is supportable on a surface by the front leg and the rearward end when the frame assembly is in the folded arrangement.

4. The convertible toddler chair and standing platform of claim 1, wherein the seat assembly further comprises a seat link interconnecting the seating panel and the frame assembly, the seat link moving the seating panel toward the standing configuration as the elevating frame is moved in a first direction, the seat link moving the seating panel toward the seating configuration as the elevating frame is moved in a second direction opposite to the first direction.

5. The convertible toddler chair and standing platform of claim 4, wherein the seat link is pivotally connected at a first end thereof to the seating panel and at a second end thereof to the frame assembly.

6. The convertible toddler chair and standing platform of claim 5, wherein the first and second end pivoting connections of the seat link are positioned in an overcenter locking relationship when the seating panel is in the standing configuration.

7. The convertible toddler chair and standing platform of claim 1, wherein the elevating frame comprising a telescoping connection with the front leg configured to allow bi-directional movement between raised and lowered positions, moving the elevating frame to the raised position positioning the seating panel in the standing configuration.

8. The convertible toddler chair and standing platform of claim 1, wherein the elevating frame further comprises a releasable lock configured to retain the elevating frame in at least a first position corresponding to the standing configuration.

9. The convertible toddler chair and standing platform of claim 1, further comprising an infant seat selectively connectible to the elevating frame.

10. A convertible toddler chair and standing platform comprising:

a foldable frame having a front leg and a pivotally coupled rear leg;

a platform and a platform support link interconnecting the front and rear legs;

an elevating frame connected to the foldable frame and moveable between opposing raised and lowered positions, the elevating frame having an attached seat assembly comprising a backrest panel and a moveably coupled seating panel, movement of the elevating frame causing the seating panel to move between a seating configuration and a standing configuration;

wherein the seat assembly further comprises a seat link interconnecting the seating panel and the frame assembly, the seat link being pivotally connected at a first end thereof to the seating panel and at a second end thereof to the frame assembly; and wherein the first and second end pivoting connections of the seat link are positioned in an overcenter locking relationship when the seating panel is in the standing configuration.

11. The convertible toddler chair and standing platform of claim 10, wherein raising the elevating frame moves the seating panel toward general alignment with the backrest panel in the standing configuration and lowering the elevating frame angles the seating panel relative to the backrest panel in the seating configuration.

12. The convertible toddler chair and standing platform of claim 11, wherein the elevating frame comprising a telescoping connection with the front leg configured to allow bi-directional movement between raised and lowered positions, and a releasable lock configured to retain the elevating frame in at least the raised position, wherein moving the elevating frame to the raised position moves the seating panel toward the standing configuration.

13. The convertible toddler chair and standing platform of claim 10, wherein the platform panel is pivotally connected to the front leg and the platform link is pivotally connected at a first end thereof to the rear leg and at a second end thereof to the platform panel, the platform panel and platform support link operable to coordinate movement of the legs and platform panel between folded and unfolded positions.

14. The convertible toddler chair and standing platform of claim 13, wherein the platform panel includes a rearward end, movement of the frame assembly toward the folded arrangement rotating the rearward end downwardly, wherein the toddler chair and standing platform is supportable on a surface by the front leg and the rearward end when the frame assembly is in the folded arrangement.

15. The convertible toddler chair and standing platform of claim 14, wherein the first and second end pivoting connections of the support link are positioned in an overcenter locking relationship when the legs and platform panel are in the unfolded positions.

16. A convertible toddler chair and standing platform comprising:

a frame assembly having a front leg and a rear leg, the front and rear legs being pivotally connected and moveable between a folded arrangement and an unfolded arrangement;

a platform panel supported by the frame assembly and moveable between a first orientation and a second orientation;

an elevating frame including a telescoping extension received in the front leg, The telescoping extension telescopically moveable along an axis of the front leg thereby enabling the elevating frame to move between a raised position and an opposing lowered position;

a seat assembly coupled to the elevating frame comprising a backrest panel and a seating panel pivotally coupled thereto; and a seat link interconnecting the seating panel and the frame assembly, the seat link being pivotally connected at a first end thereof to the seating panel and at a second end thereof to the frame assembly, wherein the seat link is operably configured to move the seating panel between a seating configuration and a standing configuration as the elevating frame is moved between the lowered and raised position.

17. The convertible toddler chair and standing platform of claim 16, wherein the first and second end pivoting connections of the seat link are positioned in an overcenter locking relationship when the seating panel is in the standing configuration.

18. The convertible toddler chair and standing platform of claim 16, wherein raising the elevating frame moves the seating panel toward general alignment with the backrest panel in the standing configuration and lowering the elevating frame angles the seating panel relative to the backrest panel in the seating configuration.

19. The convertible toddler chair and standing platform of claim 16, further comprising a platform support link pivotally connected at a first end to the rear leg and at a second end to the platform panel, the platform panel and the platform support link operably connecting the front and rear legs to coordinate movement of the legs and the platform panel between the folded and unfolded arrangements.

20. The convertible toddler chair and standing platform of claim 19, wherein the first and second end pivoting connections of the platform support link are positioned in an overcenter locking relationship when the legs and platform panel are in the unfolded arrangement.

* * * * *